US005448975A

United States Patent [19]

Sato

[11] Patent Number: 5,448,975

[45] Date of Patent: Sep. 12, 1995

[54] IGNITION TIMING CONTROL SYSTEM FOR INTERNAL COMBUSTION ENGINE

[75] Inventor: Kenichi Sato, Yokohama, Japan

[73] Assignee: Nissan Motor Co., Ltd., Yokohama City, Japan

[21] Appl. No.: 305,617

[22] Filed: Sep. 14, 1994

[30] Foreign Application Priority Data

Sep. 16, 1993 [JP] Japan ..... 5-229955

[51] Int. Cl.[6] ..... F02P 5/15

[52] U.S. Cl. ..... 123/417; 123/406

[58] Field of Search ..... 123/406, 415, 416, 417; 364/431.04

[56] References Cited

U.S. PATENT DOCUMENTS 4,879,656 11/1989 Quigley et al. ..... 123/417 X

FOREIGN PATENT DOCUMENTS 60-56149 4/1985 Japan .

61-98970 5/1986 Japan .

OTHER PUBLICATIONS

"Patent Abstracts of Japan", Group M519, vol. 10, No. 277, Sep. 19, 1986, Abstract of JP-61-98970.

"Patent Abstracts of Japan", Group M402, vol. 9, No. 191, Aug. 7, 1985, Abstract of JP-60-56149.

*Primary Examiner*—Tony M. Argenbright

*Attorney, Agent, or Firm*—Lowe, Price, LeBlanc & Becker

[57] ABSTRACT

An ignition timing control system for an internal combustion engine which is equipped with an air-fuel ratio feedback control system for controlling an air-fuel ratio to a stoichiometric value. In the ignition timing control system, a basic ignition timing is corrected in accordance with an ignition timing correction amount which is calculated in accordance with a difference between an air-fuel ratio within in a combustion chamber for each engine cylinder and a stoichiometric air-fuel ratio. The air-fuel ratio within the combustion chamber is calculated from an air-fuel ratio feedback control parameter, taking account of a predetermined time lag characteristic of a variation of the air-fuel ratio relative to that of the control parameter.

7 Claims, 10 Drawing Sheets

FIG.7
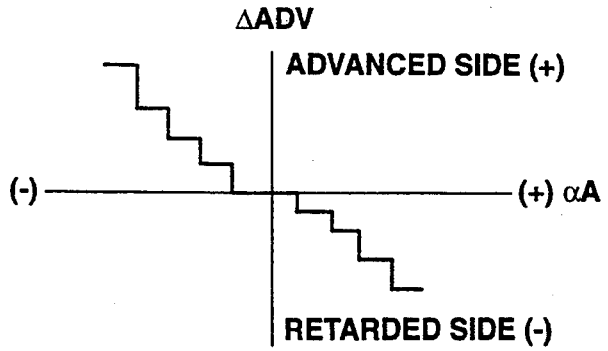
FIG.8A
FIG.8B
FIG.8C
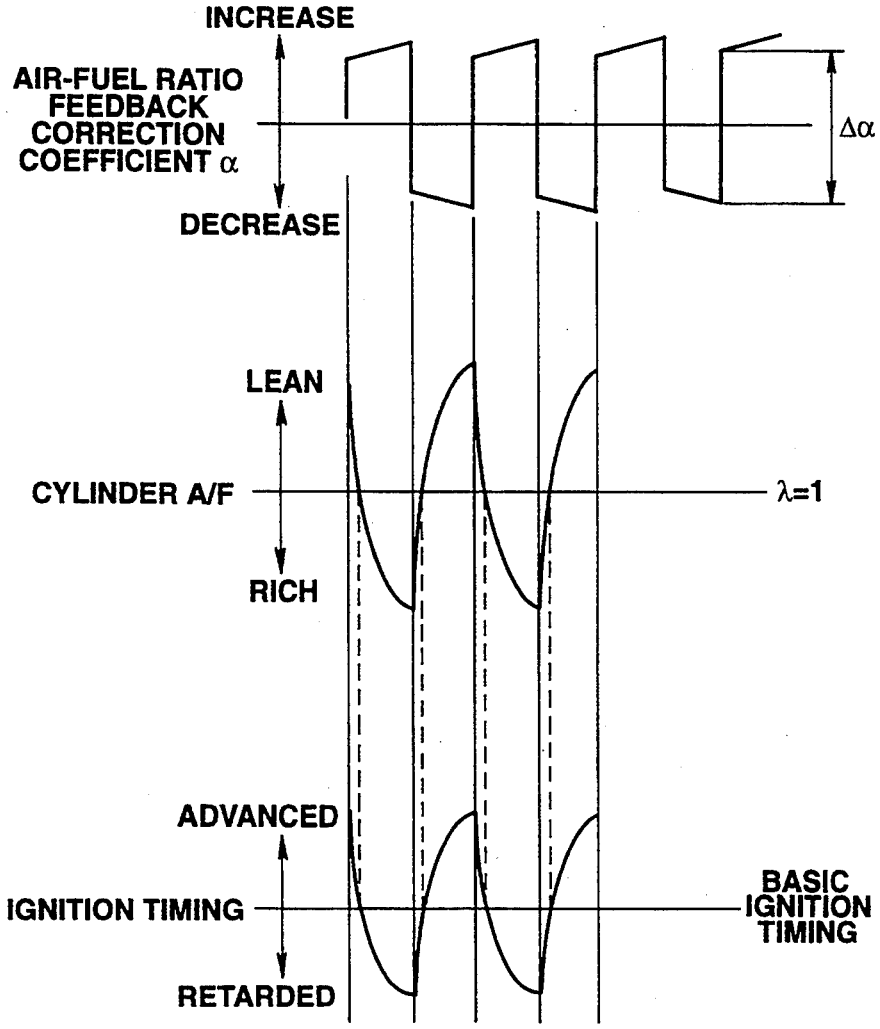

IGNITION TIMING CONTROL SYSTEM FOR INTERNAL COMBUSTION ENGINE

BACKGROUND OF THE INVENTION

1. Field of the Invention

The present invention relates to improvements in an ignition timing control system for an internal combustion engine, and more particularly to an ignition timing control system for the purpose of stabilizing engine revolution, incorporated with an air-fuel ratio feedback control system.

2. Description of the Prior Art

Most automotive internal combustion engines have been equipped with an air-fuel ratio feedback control system to feedback-control an air-fuel ratio to a stoichiometric value in order to effectively activate a three-way catalytic converter. The air-fuel ratio control system includes an air-fuel ratio sensor (an oxygen sensor in practice) which is disposed in an exhaust gas passageway to detect the concentration of oxygen in exhaust gas and produce a rich-lean signal representative of the air-fuel ratio being in a rich or lean state. In response to this signal, an air-fuel ratio feedback control coefficient $\alpha$ is set under a known proportional plus integral control. A basic fuel injection amount Tp determined corresponding to the amount of intake air to be inducted into the engine is corrected with the air-fuel ratio feedback correction coefficient $\alpha$ thereby obtaining a fuel injection amount Ti ($=Tp\times\alpha$) to feedback-control the air-fuel ratio to the stoichiometric value.

In such an air-fuel ratio feedback control system, the air-fuel ratio feedback correction coefficient $\alpha$ changes periodically in response to the periodical rich-lean signal from the oxygen sensor. Accordingly, assuming that the basic fuel injection amount Tp is constant, the fuel injection amount Ti takes its maximum value at the maximum value of the air-fuel ratio feedback correction coefficient $\alpha$, whereas it takes its minimum value at the minimum value of the air-fuel ratio feedback correction coefficient $\alpha$. Under such changes in the fuel injection amount Ti, fluctuation in engine revolution will occur, which is particularly enormous at engine idling.

In view of the above, it has been proposed to control an ignition (spark) timing control system in relation to the air-fuel ratio control system, for example, disclosed in Japanese Patent Provisional Publication No. 61-98970. In this proposition, as shown in FIG. 9, a deviation ($\alpha$-$\alpha_{AVE}$) between the feedback correction coefficient $\alpha$ and a moving average $\alpha_{AVE}$ of the air-fuel ratio feedback correction coefficient $\alpha$ is determined, and then an ignition timing is correct-controlled in accordance with the deviation in such a manner as to be in a retarded side in an amount corresponding to the magnitude of the deviation when the deviation is positive while in an advanced side in an amount corresponding to the magnitude of the deviation when the deviation is negative, thereby intending stabilization of engine revolution at engine idling.

However, drawbacks have been encountered in the above-discussed conventional control manner of the ignition timing control system in corporation with the air-fuel ratio feedback control system, as discussed hereinafter. First, a consideration will be made on actual air-fuel ratio of each engine cylinder of an internal combustion engine upon change in the fuel injection amount. As shown in FIG. 10A, when the amount (an fuel injection amount) of fuel to be injected to a certain cylinder changes by an amount ($\Delta fuel=Tp\times\Delta\alpha$ where $\Delta\alpha$ is a step change amount of the air-fuel ratio feedback correction coefficient $\alpha$) as shown in FIG. 10B, the amount of fuel to be introduced into the cylinder changes along a broken line in FIG. 10B with the number of times of air intake in the cylinder because a part of the injected fuel forms fuel flow on the wall surface of an air intake passageway. As clearly seen from FIG. 10B, the response characteristics of the fuel to be supplied to the cylinder is regarded to have a time lag characteristic with which the amount of fuel to be sucked to the cylinder gradually increases with the number of times of air intake.

Accordingly, when the air-fuel ratio feedback correction coefficient $\alpha$ changes as shown in FIG. 11A corresponding to an air-fuel ratio (A/F) change detected by the oxygen sensor in the exhaust gas passageway, the actual air-fuel ratio (cylinder A/F) in each cylinder changes as shown in FIG. 11D which indicates an example of the first cylinder (#1) from an end of the engine. It will be seen that the air-fuel ratio in each cylinder does not take a change manner corresponding to that of the air-fuel ratio feedback correction coefficient $\alpha$, and therefore the change in the cylinder air-fuel ratio has a time lag characteristic (for the reason of FIG. 10B relative to the change in the air-fuel ratio feedback correction coefficient $\alpha$). Consequently, when the air-fuel ratio feedback correction coefficient $\alpha$ changes, for example, from a decreasing side to an increasing side, the air-fuel ratio in each cylinder cannot immediately come to the rich side, shortly keeping it in the lean side.

In view of the above, with the above-discussed conventional control manner for the ignition timing control system, correction of the ignition timing is made in accordance with the air-fuel ratio feedback correction coefficient. As a result, the following shortcomings may occur: The ignition timing is unavoidably retarded though the actual air-fuel ratio in each cylinder is in the lean side, whereas it is unavoidably advanced though the actual air-fuel ratio is in the rich side, thereby rather increasing an engine revolution fluctuation.

Another conventional control manner for an ignition timing control system has been proposed, for example, in Japanese Patent Provisional Publication No. 60-56149, in which the ignition timing is retarded in response to the judgment (due to oxygen sensor output) of the air-fuel ratio being in the rich side, and it is advanced in response to the judgment of the air-fuel ratio being in the lean side. Thus, this control manner does not take account of a time lag of exhaust gas flow from the cylinder to the oxygen sensor and the retarded response of the oxygen sensor and therefore, an actual air-fuel ratio in each cylinder cannot be detected, generating a problem in that the ignition timing is unavoidably retarded even though the actual air-fuel ratio in each cylinder is in the lean side.

SUMMARY OF THE INVENTION

It is an object of the present invention to provide an improved ignition timing control system for an internal combustion engine, incorporated with an air-fuel ratio feedback control system, which can effectively overcome drawbacks encountered in similar conventional ignition timing control systems.

Another object of the present invention is to provide an improved ignition timing control system for an internal combustion engine, incorporated with an air-fuel ratio feedback control system, which can effectively prevent engine revolution from fluctuation suppressing engine hunting even though the ignition timing is controlled in response to a control parameter of the air-fuel ratio feedback control system.

A further object of the present invention is to provide an improved ignition timing control system for an internal combustion engine, incorporated with an air-fuel ratio feedback control system, in which an ignition timing for each engine cylinder is controlled in accordance with an actual air-fuel ratio prevailing in the corresponding cylinder thereby to be advanced or retarded accurately in response to a lean or rich (in fuel) state of the air-fuel ratio in the combustion chamber.

An ignition timing control system S of the present invention is schematically illustrated in FIG. 1. The ignition timing control system S is for an internal combustion engine and incorporated with an air-fuel ratio feedback control system F including an air-fuel ratio sensor disposed in an exhaust gas passageway to generate a signal representative of an air-fuel ratio of exhaust gas, means for setting an air-fuel ratio feedback correction coefficient in accordance with the signal to correct a fuel injection amount so as to feedback-control the air-fuel ratio to a stoichiometric air-fuel ratio. The ignition timing control system comprises cylinder air-fuel ratio detecting means M1 for detecting an air-fuel ratio within the combustion chamber of an engine cylinder of the engine. Ignition timing correction amount calculating means M2 is provided to calculate an ignition timing correction amount in accordance with the air-fuel ratio within the combustion chamber. Additionally, ignition timing correcting means M3 is provided to correct an ignition timing set in accordance with an engine operating condition, in accordance with said ignition timing correction amount.

With the ignition timing control system of the present invention, the ignition timing for each cylinder is corrected in accordance with the actual air-fuel ratio prevailing in the corresponding cylinder. Accordingly, the ignition timing advance or retardation is accomplished precisely in response to a lean or rich state of the air-fuel ratio in the cylinder, thereby effectively preventing engine hunting or engine revolution fluctuation, particularly at engine idling even under ignition timing correction in relation to an air-fuel ratio control parameter.

BRIEF DESCRIPTION OF THE DRAWINGS

FIG. 7 is a graph showing a map for looking up the ignition timing correction amount, used in the routine of FIG. 6;

FIGS. 8A, 8B and 8C are graphs showing a manner of correcting an ignition timing in the ignition timing control system of FIG. 2;

DETAILED DESCRIPTION OF THE INVENTION

Figure 1:
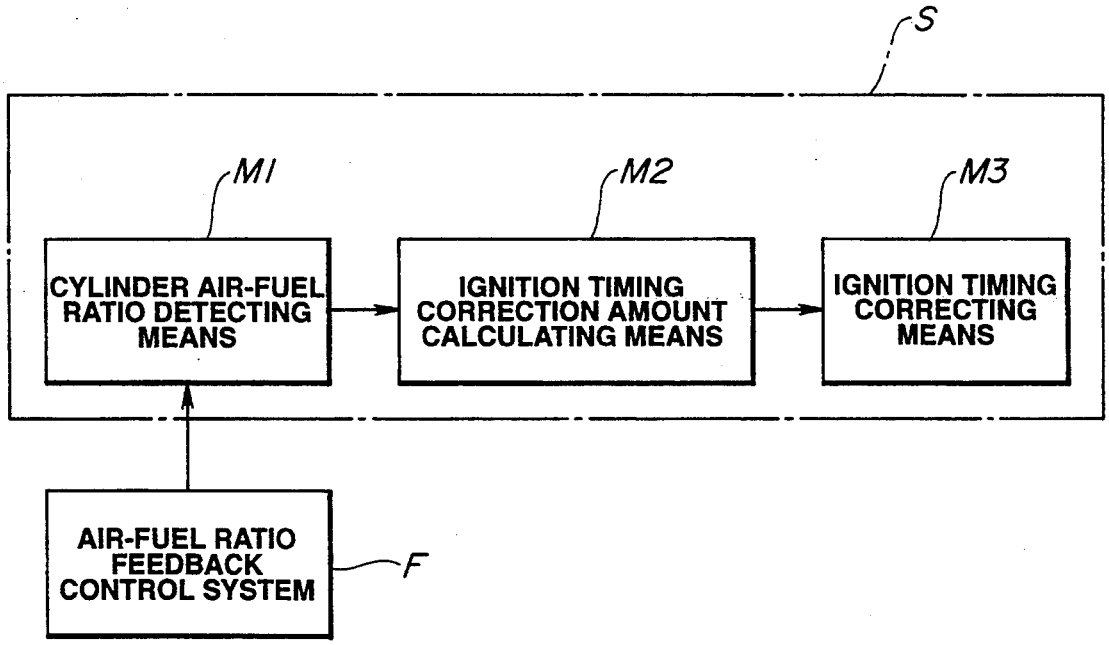
FIG. 1 is a block diagram showing the principle of an ignition timing control system of the present invention.
Figure 2:
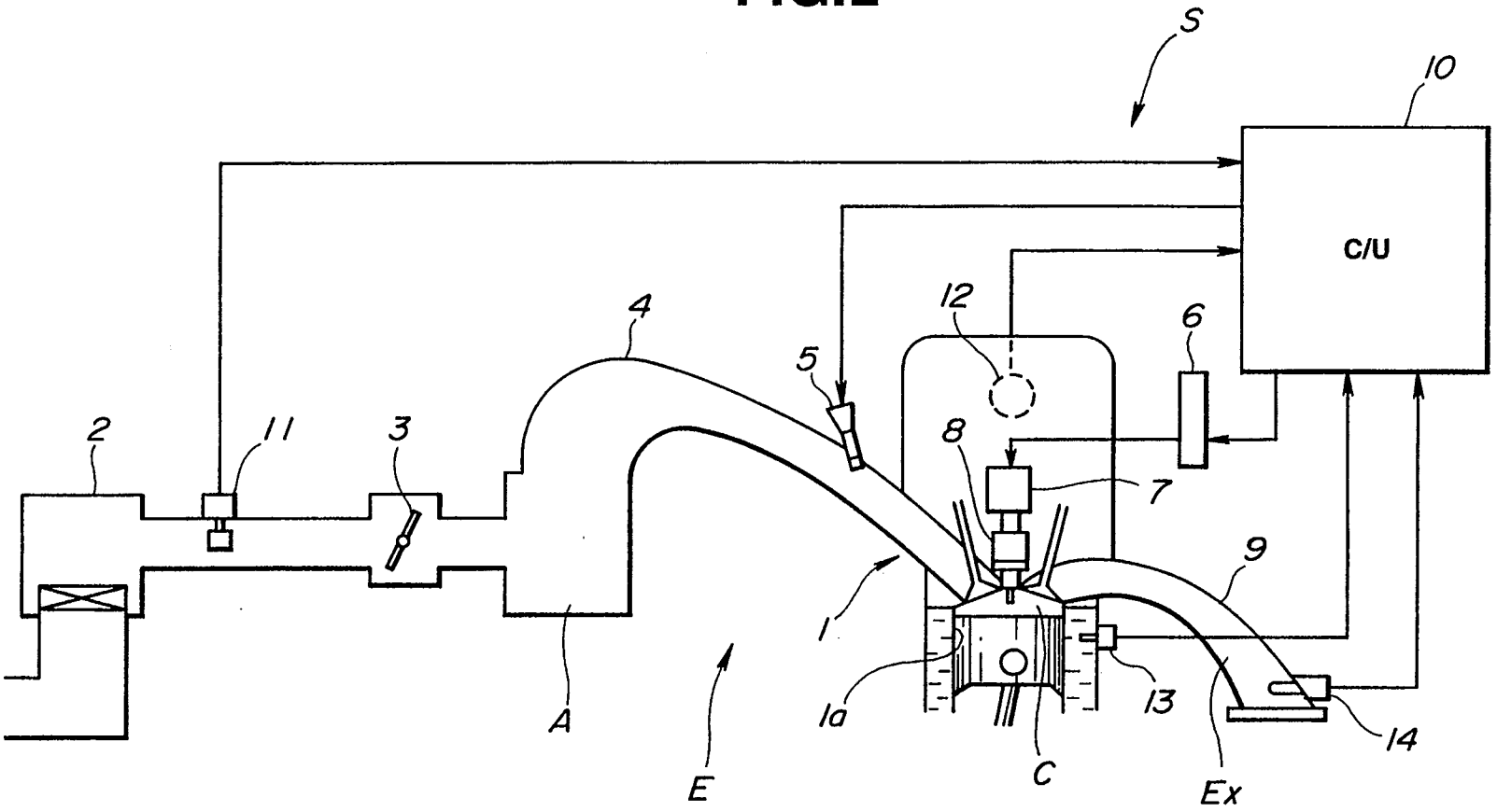
FIG. 2 is a schematic illustration of an embodiment of the ignition timing control system in accordance with the present invention.

Referring now to FIG. 2, a preferred embodiment of an ignition timing control system is illustrated by the reference character S and for an internal combustion engine E of an automotive vehicle (not shown). The engine E includes an engine body 1 having engine cylinders 1*a* one of which is shown. A combustion chamber C is formed in a part of each engine cylinder 1*a*. The engine body 1 is provided with an intake air passageway A through which intake air is sucked to the cylinders 1*a*. A part of the intake air passageway A is formed in an air filter 2 and an intake manifold 4. A throttle valve 3 is disposed in the intake passageway A between the air filter 2 and the intake manifold 4.

An electromagnetically operated fuel injector valve 5 is disposed projecting into each branch runner (only one of them shown) of the intake manifold 4 and located near the cylinder 1*a*. The fuel injector valve 5 is adapted to inject fuel into intake air flowing through the intake air passageway A to form air-fuel mixture. The fuel injector valve 5 is arranged to open so as to inject fuel having a previously regulated pressure, in response to a drive pulse signal which is output from a control unit 10 in timed relation to engine speed or engine revolution. More specifically, the fuel injector valve 5 has a solenoid (not shown) which is adapted to be energized upon being supplied with electric current in response to the drive pulse signal, in which the fuel injector valve 5 opens to inject fuel when the solenoid is energized. A fuel injection amount (the amount of fuel to be injected from the injector at each injection) is controlled in accordance with the pulse width of the drive pulse signal.

The air-fuel mixture formed from the intake air and the injected fuel is sucked into the combustion chambers C of the cylinders la and ignited by a spark plug 8. The spark plug 8 is operated through a power transistor unit 6 and an ignition coil 7 in response to an ignition signal from the control unit 10, thereby generating a spark in each combustion chamber C. The air-fuel mixture within the combustion chamber C is combusted upon being ignited under the effect of the thus generated spark from the spark plug 8. Exhaust gas generated in each combustion chamber is discharged out of the engine E through an exhaust gas passage Ex a part of which is formed in an exhaust manifold 9.

An airflow meter 11 is disposed in the intake air passageway A and located between the air filter 2 and the throttle valve 3. The airflow meter 11 is electrically connected to the control unit 10 and adapted to detect an intake air amount Q (the amount of intake air to be sucked into the cylinders 1*a*) of the engine E and output a signal representative of the intake air amount Q. An crankangle sensor 12 is operatively incorporated with a cam shaft (not shown) of the engine E and adapted to generate a first signal every a unit crankangle and a second signal every a standard crankangle, so that the crankangle sensor 12 indirectly detects an engine speed N. Thus, the crankangle sensor 12 functions to output a signal representative of the engine speed N. The crankangle sensor 12 is adapted to also output an ignition cylinder discrimination signal which represents an engine cylinder (defining the combustion chamber 1*a*) in which an ignition is to be made.

A coolant temperature sensor 13 is disposed in a water jacket (no numeral) of the engine body 1 and adapted to detect a coolant temperature Tw (the temperature of engine coolant in the water jacket) and to output a signal representative of the coolant temperature Tw. An air-fuel ratio or oxygen sensor 14 is disposed in the exhaust gas passageway Ex or installed to the exhaust manifold 9 to output a signal representative of air-fuel ratio (oxygen-combustibles ratio) in exhaust gas passing through the exhaust gas passageway Ex, in which the value of the signal corresponds to oxygen concentration in exhaust gas and largely changes at stoichiometric air-fuel ratio of the air-fuel mixture to be supplied Co the cylinders 1*a* of the engine body 1. The air-fuel ratio (or the concentration of fuel) is shifted Co a so-called rich (in fuel) side if the fuel injection amount is enlarged relative to a certain amount of intake air, whereas it is shifted to a so-called lean (in fuel) side if the fuel injection amount is minimized relative to the certain amount of intake air. Thus, the air-fuel ratio sensor 14 can output the signals which respectively correspond to air-fuel ratios at the rich and lean sides.

The above meter and sensors 11, 12, 13, 14 are electrically connected to the control unit 10, so that the control unit 10 is supplied with a variety of signals from the meter and sensors 11, 12, 13, 14. The control unit 10 includes a microcomputer (not shown).

Hereinafter, a manner of operation of the ignition timing control system S of the present invention will be discussed with reference to flowcharts of FIGS. 3 to 10, in which the control unit 10 is adapted to make a computation processing in accordance with flowcharts of FIGS. 3 to 6 and in response to the signals from the meter and sensors 11, 12, 13, 14, so as to control the fuel injection amount of the fuel injector valve 5 and the ignition timing of the spark plug 8.

Figure 3:
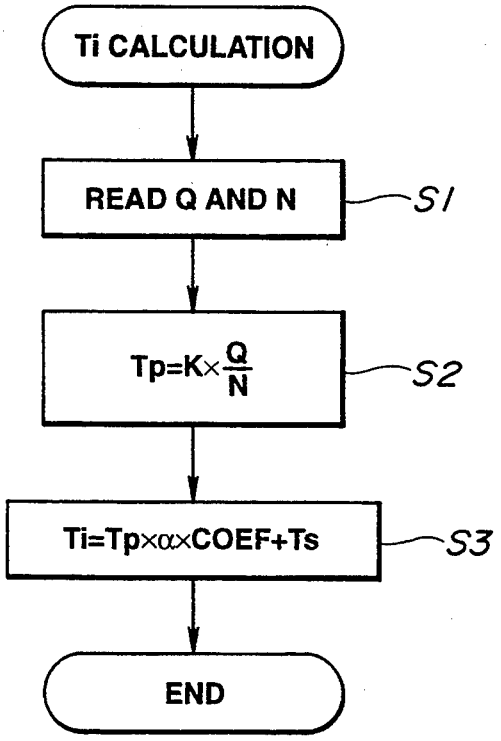
FIG. 3 is a flowchart of a routine of calculation of a fuel injection amount which is used in control of the ignition timing control system of FIG. 2.

FIG. 3 shows a routine of calculation of the fuel injection amount Ti. The program of this flowchart is executed at predetermined times. At a step S1, the intake air amount Q is read from the signal from the airflow meter 11. Additionally, the engine speed N is read from the signal from the crankangle sensor 12. At a step S2, a basic value Tp (referred to as "basic fuel injection amount") of the fuel injection amount is calculated in accordance with an equation of $Tp=K\times Q/N$ where K is a constant. At a step S3, the final fuel injection amount Ti is calculated in accordance with the following equation in which the basic fuel injection amount Tp is corrected in accordance with various correction coefficients, such as a current air-fuel ratio feedback correction coefficient $\alpha$ which is to be set by a routine of calculation of an air-fuel ratio feedback correction coefficient ($\alpha$) discussed after in FIG. 4:

$$Ti=Tp\times\alpha\times COEF+Ts$$

where COEF is a variety of correction coefficients including an engine coolant correction coefficient; and Ts is a voltage correction amount depending upon a battery voltage.

When the fuel injection amount Ti has been calculated, the drive pulse signal having a pulse width corresponding to Ti is output to the fuel injector valve 5 for each cylinder 1*a* at a predetermined timing in timed relation to engine speed or engine revolution, thereby accomplishing a fuel injection from each fuel injector valve 8 to the corresponding cylinder 1*a*.

Figure 4:
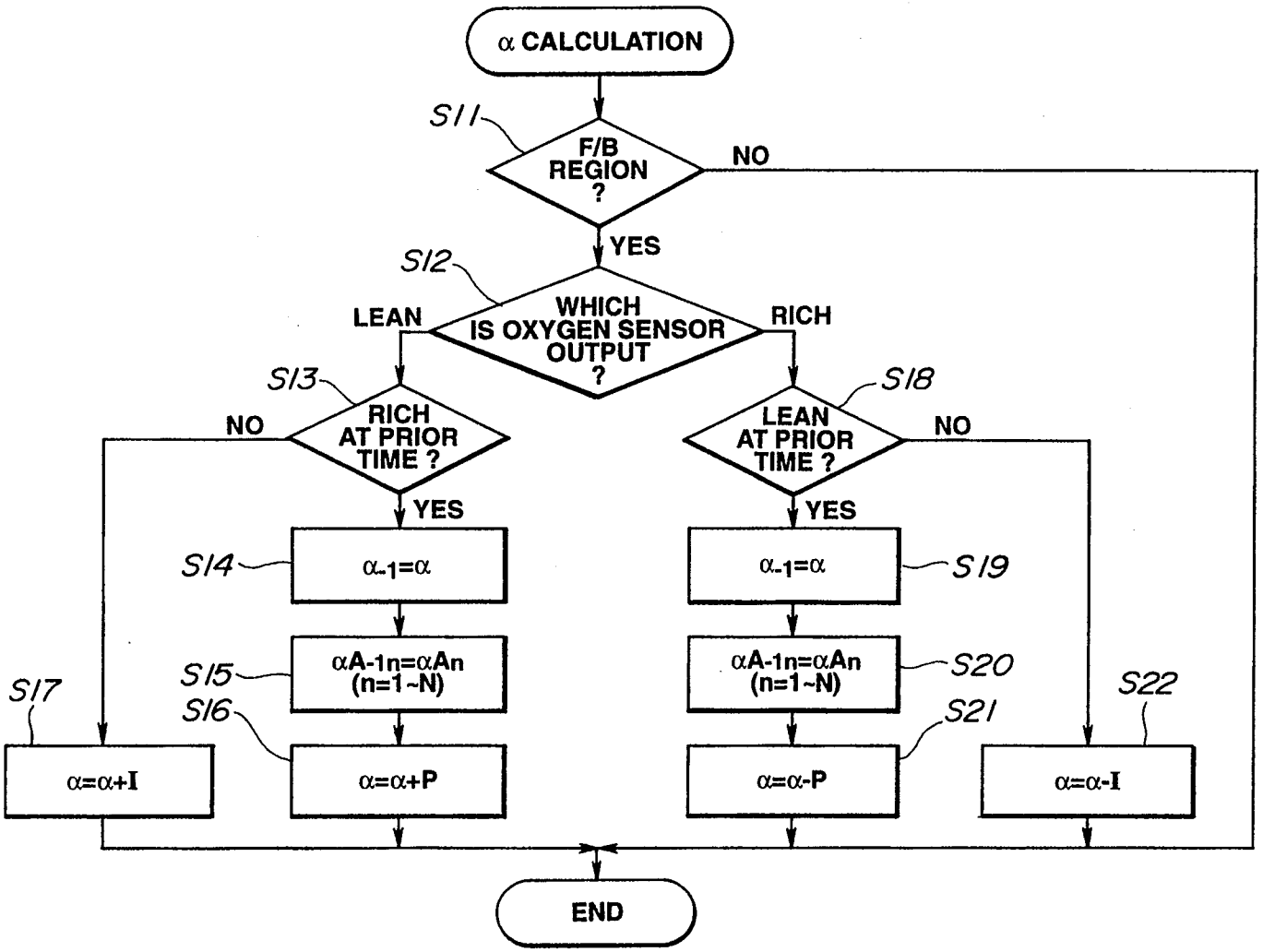
FIG. 4 is a flowchart of a routine of calculation of a routine of calculation of an air-fuel ratio feedback correction coefficient which is used in control of the ignition timing control system of FIG. 2.

FIG. 4 shows a routine of calculation of the air-fuel ratio feedback correction coefficient ($\alpha$). The program of this routine is executed at predetermined times. At a step 11 of this routine, a judgment is made as to whether the current condition is in an air-fuel ratio feedback control region (F/B region) or not. The current condition includes the engine speed N, the basic fuel injection amount Tp, the coolant temperature Tw, the state of the output signal from the oxygen sensor 14 and the like. When the current condition is in the air-fuel ratio feedback control region, a flow goes to a step S12 at which the output voltage of the oxygen sensor 14 is read and compared with a slice level voltage corresponding to a stoichiometric air-fuel ratio, so that judgment is made as to whether the current air-fuel ratio is in the rich side or in the lean side.

When the air-fuel ratio detected from the oxygen sensor 14 is in the lean side, the flow goes to a step S13 at which a judgment is made as to whether the air-fuel ratio at a prior time judgment (the judgment at the immediately preceding routine or computer computation cycle) is in the rich side or not. In case that the air-fuel ratio is in the rich side at the prior time judgment, air-fuel ratio inversion is made from the rich side to the lean side, and accordingly the flow goes to a step S14 at which the current (immediately before the inversion) air-fuel ratio feedback correction coefficient $\alpha$ is memorized as $\alpha_{-1}$. At a step S15, a current (immediately before the inversion) "cylinder air-fuel ratio corresponding value" $\alpha A_n$ is memorized as $\alpha A_{-1n}$. The current cylinder air-fuel ratio corresponding value $\alpha A_n$ is a current value corresponding to an air-fuel ratio in the combustion chamber C of the cylinder 1*a* and calculated at a step S46 in a routine of calculation of an ignition timing correction amount ($\Delta ADV_n$) as discussed after in FIG. 6. The subscript "n" represents the number (No.) of the cylinder 1*a*, ordered from one end of the engine body 1, so that n=1 indicates the nearest cylinder 1*a* to the engine body one end. Here, the current (immediately before the inversion) cylinder air-fuel ratio corresponding value $\alpha A_{-1n}$ is memorized as $\alpha A_n$ for each cylinder (n=1 to N). It will be understood that $\alpha A_{-1n}$ may be set commonly at a predetermined lean side air-fuel ratio corresponding value for n=1 to N.

At a step S16, a predetermined proportional amount P is added to the current air-fuel ratio feedback correction coefficient R to renew the air-fuel ratio feedback correction coefficient $\alpha$ largely to an increasing side, for a proportional control.

In case that the judgment is so made that the air-fuel ratio is not in the rich side at the step S13, so that the air-fuel ratio in the lean side is continuing. Then, the flow goes to a step S17 at which a predetermined integral amount I ($<<$P) is added to the current air-fuel ratio feedback correction coefficient $\alpha$ to renew the air-fuel ratio feedback correction coefficient $\alpha$ slightly to an increasing side, for an integral control.

When the air-fuel ratio detected from the oxygen sensor 14 is in the rich side at the step S12, the flow goes to a step S18 at which a judgment is made as to whether the air-fuel ratio at a prior time judgment (the judgment at the immediately preceding routine or computer computation cycle) is in the lean side or not. In case that the air-fuel ratio is in the lean side at the prior time judgment, air-fuel ratio inversion is made from the lean side to the rich side, and accordingly the flow goes to a step S19 at which the current (immediately before the inversion) air-fuel ratio feedback correction coefficient $\alpha$ is memorized as $\alpha_{-1}$. At a step S20, a current (immediately before the inversion) cylinder air-fuel ratio corresponding value $\alpha A_n$ is memorized as $\alpha A_{-1n}$. The current cylinder air-fuel ratio corresponding value $\alpha A_n$ is a current value corresponding to an air-fuel in the cylinder 1*a* and calculated at the step S46 of a routine of calculation of an ignition timing correction amount ($\Delta ADV_n$) calculation routine in FIG. 6. The subscript "n" represents the number (No.) of the cylinder 1*a*, ordered from one end of the engine body 1, so that n=1 indicates the nearest cylinder 1*a* to the engine body one end. Here, the current (immediately before the inversion) cylinder air-fuel ratio corresponding value $\alpha A_{-1n}$ is memorized as $\alpha A_n$ for each cylinder (n=1 to N). It will be understood that $\alpha A_{-1n}$ may be set commonly at a predetermined rich side air-fuel ratio corresponding value for n=1 to N.

At a step S21, a predetermined proportional amount P is subtracted from the current air-fuel ratio feedback correction coefficient $\alpha$ to renew the air-fuel ratio feedback correction coefficient $\alpha$ largely to a decreasing side, for a proportional control.

In case that the judgment is so made that the air-fuel ratio is not in the lean side at the step S18, the air-fuel ratio in the rich side is continuing. Then, the flow goes to a step S22 at which a predetermined integral amount I ($<<$P) is subtracted from the current air-fuel ratio feedback correction coefficient $\alpha$ to renew the air-fuel ratio feedback correction coefficient $\alpha$ slightly to a decreasing side, for an integral control.

In case that the judgment is so made that the current condition is not in the air-fuel ratio feedback control region at the step S11, this routine is terminated at this step. Then, the air-fuel ratio feedback correction coefficient $\alpha$ is clamped at its prior time value (a value at the immediately preceding routine or computer computation cycle).

Figure 5:
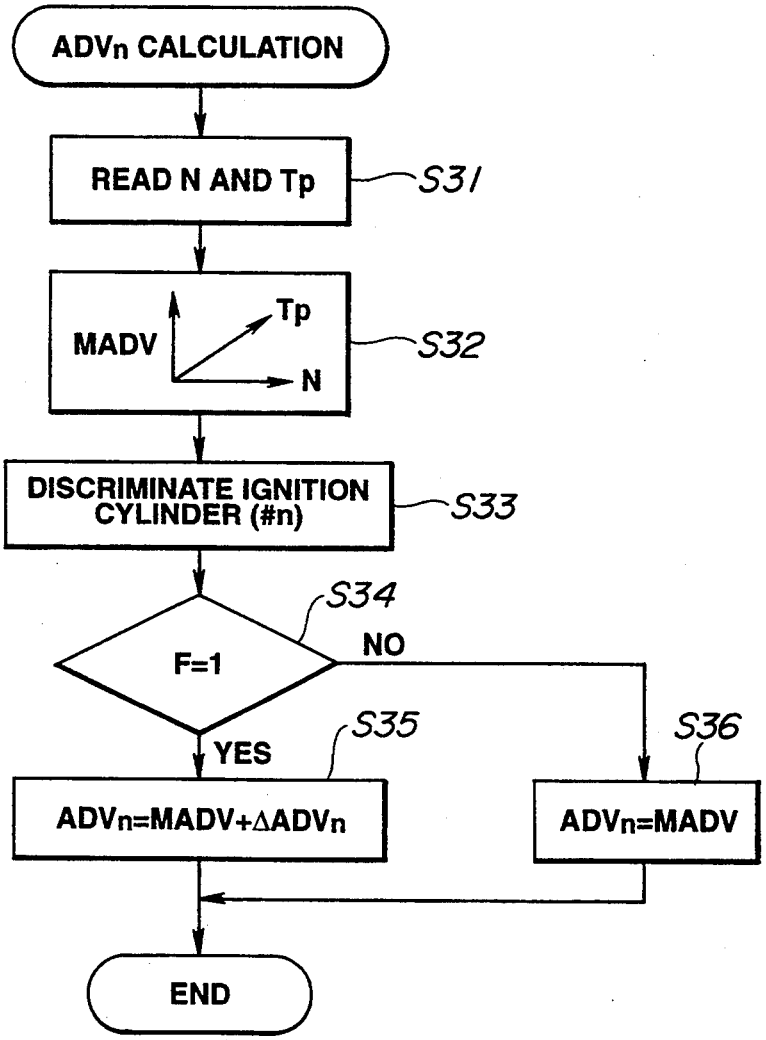
FIG. 5 is a flowchart of a routine of calculation of an ignition timing used in control of the ignition timing control system of FIG. 2.

FIG. 5 shows a routine of calculation of an ignition timing ($ADV_n$) for each cylinder. This routine is executed at predetermined times. At a step S31, the engine speed N and the basic fuel injection amount, Tp are read. At a step S32, a basic ignition timing a basic ignition advance angle characteristic) MADV is looked up from a map in accordance with the actual engine speed N and the basic fuel injection amount Tp. In the map, the MADV is set in accordance with the engine speed N and the basic fuel injection amount Tp.

At a step 33, a next "ignition cylinder" (a cylinder in which a next time ignition is made) is discriminated in response to the ignition cylinder discrimination signal from the crankangle sensor 12, in which the number (No. or #n) of the cylinder is indicated. At a step S34, a judgment is made on a value at an ignition timing correction flag F which has been determined in the ignition timing correction amount calculation routine in FIG. 6 as discussed after). When F=1 (indicating necessity of correction), the flow goes to a step S35. At the step S35, the final ignition timing (spark advance angle) ADVn is calculated by adding the ignition timing correction amount ΔADVn (which has been calculated in the ignition timing correction amount calculation routine in FIG. 6 and corresponding to the ignition cylinder (#n)) to the basic ignition timing MADV as shown in the following equation:

$$ADV_n = MADV + \Delta ADV_n$$

When F=0 at the step S34, the flow goes to a step S36 at which the basic ignition timing MADV is set as the final ignition timing ADVn for the ignition cylinder (#n) as it is. It will be understood that other various corrections are made in practice; however, they are omitted here for the purpose of simplicity of illustration.

When the final ignition timing ADVn for the ignition cylinder (#n) is determined, the ignition signal is supplied at this timing to the power transistor unit 6 so that high voltage current is supplied to the spark plug 8 thereby igniting the air-fuel mixture in the ignition cylinder (#n).

Figure 6:
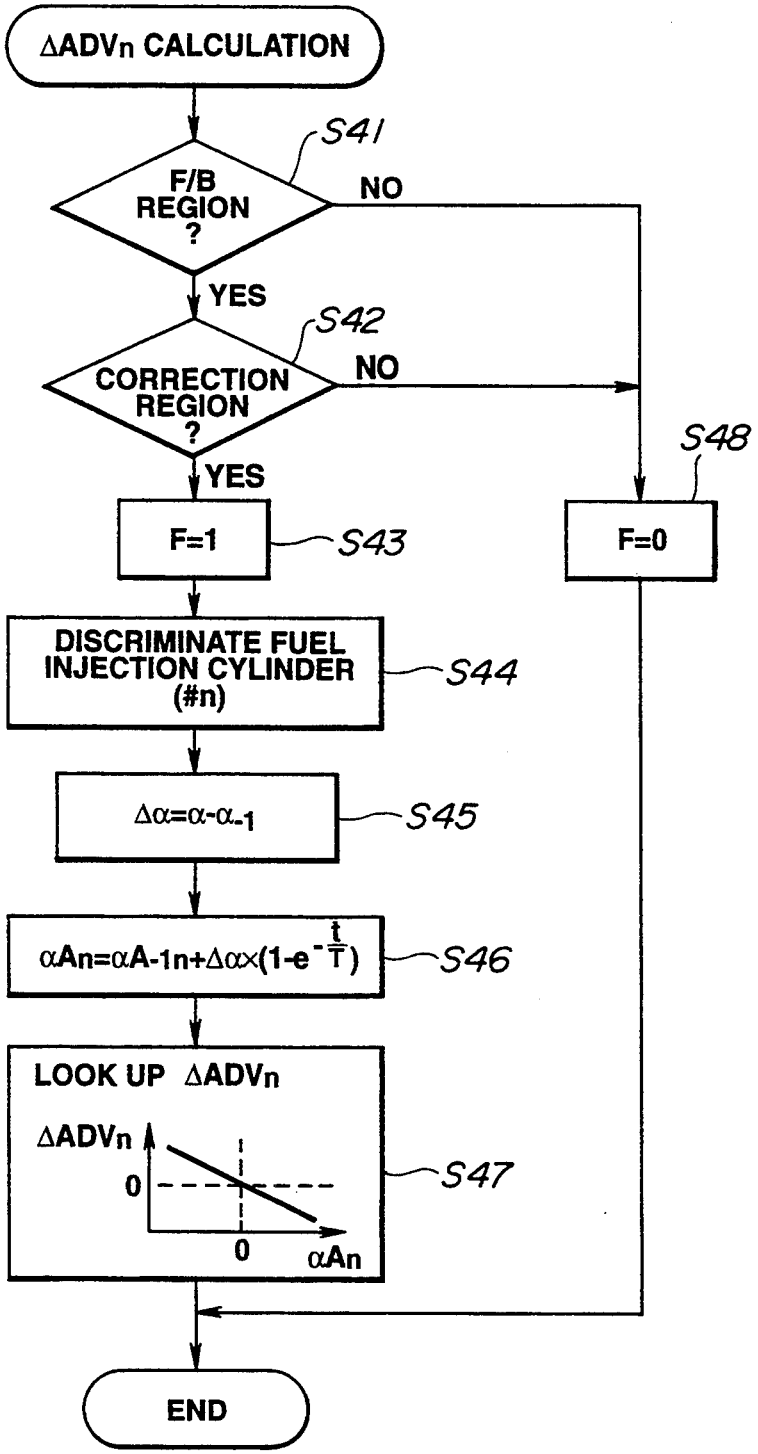
FIG. 6 is a flowchart of a routine of calculation of an ignition timing correction amount used in control of the ignition timing control system of FIG. 2.
Figure 9:
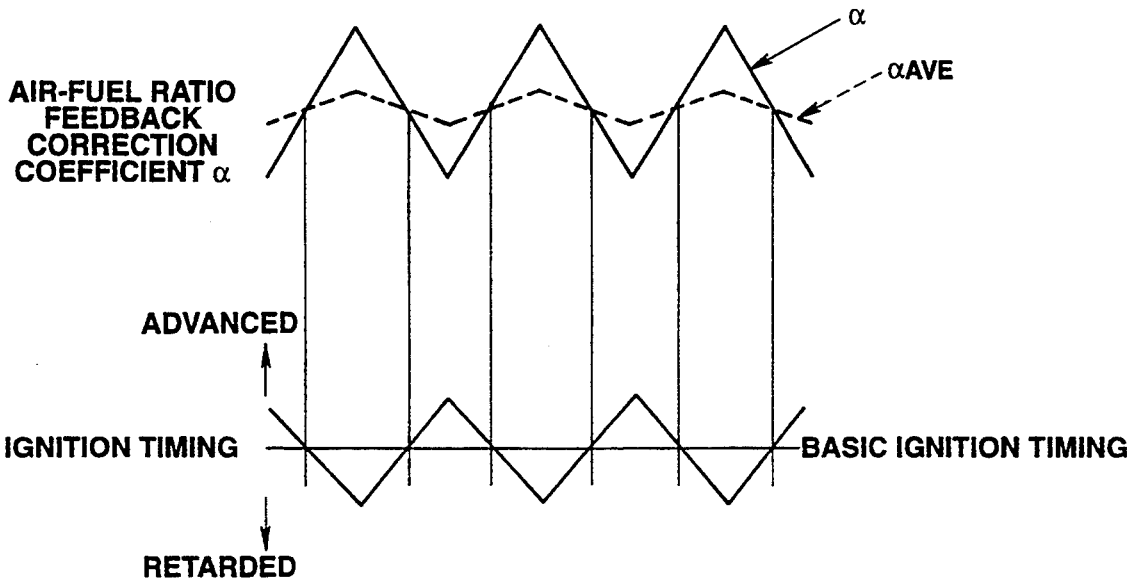
FIG.9 PRIOR ART
FIG. 9 is a graph showing a manner of correcting an ignition timing in a conventional ignition timing control system.

FIG. 6 shows a routine of calculation of the ignition timing correction amount ($\Delta ADV_n$). This routine is executed at predetermined times. At a step S41, a judgment is made as to whether the current condition is in the air-fuel feedback control region (F/B region) or not. In case of being in the air-fuel ratio feedback region, the flow goes to a step S42 at which a judgment is made as to whether the current condition is in an ignition timing correction region (in which correction of the ignition timing is necessary) or not. It will be understood that such an ignition timing correction may be carried out throughout whole the air-fuel ratio feedback control region thereby omitting the step S42; however, the correction region judgment step of S42 is provided in this embodiment in order to shorten the time required for calculation in controls including other routines, made in the control unit 10.

In case of the judgment of the current condition being in the ignition timing correction region at the step S42, the flow goes to a step S43 to accomplish calculation of the ignition timing correction amount DADVn. At the step S43, "1" is set at an ignition timing correction flag F. At a step S44, a next "fuel injection cylinder" ( a cylinder (#n) to which fuel injection is made) into which a next fuel injection is made is discriminated in response to the ignition cylinder discrimination signal from the crankangle sensor 12. At a step S45, the value of $\alpha_{-1}$ memorized at the step 14 or 19 in the above-discussed $\alpha$ calculation routine of FIG. 4 is read. The value of $\alpha_{-1}$ is a value of the air-fuel ratio feedback correction coefficient $\alpha$ at a time immediately before the last inversion of the air-fuel ratio correction coefficient $\alpha$. Additionally, a variation amount $\Delta a = \alpha - \alpha_{-1}$ (See FIG. 8) from the time immediately before the inversion to the current time is calculated.

At the step S46, reading is made for the value of $\alpha A_{-1n}$ which is for the fuel injection cylinder (#n) and memorized at the step S15 or 20 of the above-discussed $\alpha$ calculation routine in FIG. 4. The value of $\alpha A_{-1n}$ is a value of the cylinder air-fuel ratio corresponding value $\alpha A_n$ at a time immediately before the last inversion of the air-fuel ratio feedback correction coefficient $\alpha$. Additionally, the current cylinder air-fuel ratio corresponding value $\alpha A_n$ for the fuel injection cylinder (#n) is calculated in accordance with the above variation amount $\Delta\alpha$ by the following equation, taking account of a predetermined time lag characteristic as shown in FIG. 10B:

$$\alpha A_n = \alpha A_{-1n} + \Delta\alpha \times (1 - e^{-t/T})$$

where T is a time constant and has been previously set in the memory of the control unit 10 (T is preferably variable in accordance with engine operating regions or conditions); t is the number of times of air intake for the fuel injection cylinder (#n) since the last inversion of the air-fuel ratio feedback correction coefficient $\alpha$; and e is an exponential function.

Figure 10A:
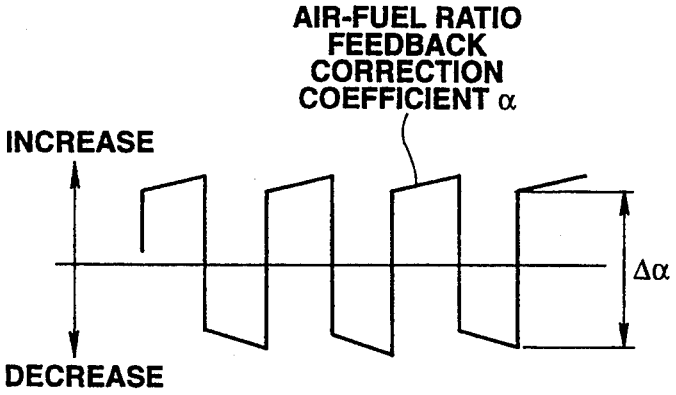
FIGS. 10A and 10B are graphs showing a section characteristic of fuel into an engine cylinder, in relation to a variation in air-fuel ratio feedback correction coefficient.
Figure 10B:
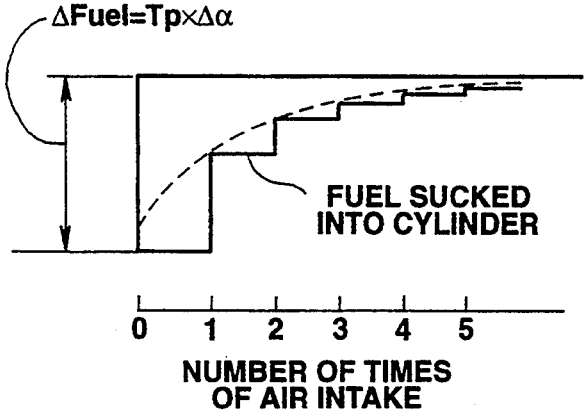
Figure 11A:
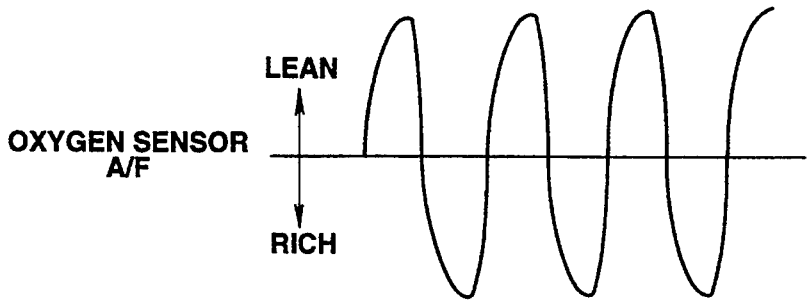
FIGS. 11A, 11B, 11C and 11D are graphs showing an air-fuel ratio variation in an engine cylinder, in relation to an air-fuel ratio control and to an engine operation.
Figure 11B:
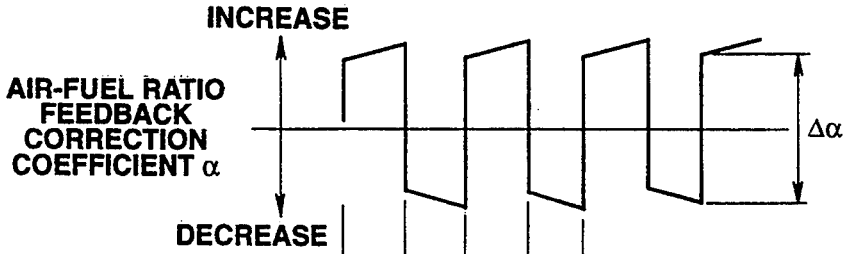
Figure 11C:
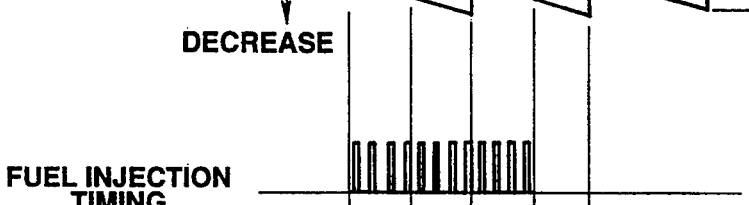
Figure 11D:
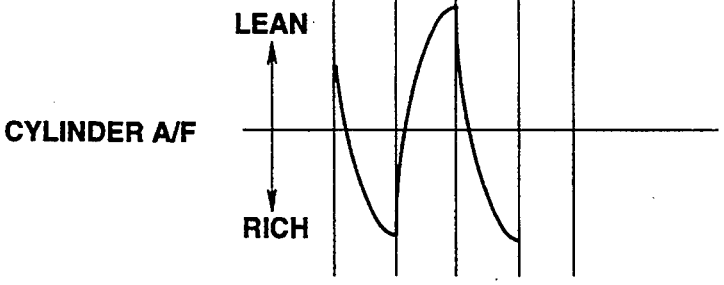

An actual air-fuel ratio (cylinder air-fuel ratio) within the combustion chamber C of the cylinder 1*a* changes with a predetermined time lag characteristic (as shown in FIG. 10B) relative to a control parameter (such as the air-fuel ratio feedback correction coefficient) of the air-fuel ratio feedback control system F. Accordingly, the cylinder air-fuel ratio corresponding value $\alpha A_n$ is calculated by the above equation to represent the actual air-fuel ration in the combustion chamber.

At a step 47, the ignition timing correction amount $\Delta ADV_n$ is looked up from a map (as shown in FIG. 7) in accordance with the actually calculated cylinder air-fuel ratio corresponding value $\alpha A_n$ for the fuel injection cylinder (#n). In the map, the ignition timing correction amount $\Delta ADV$ is set in accordance with the cylinder air-fuel ratio corresponding value $\alpha A$. More specifically, the map of FIG. 7 has the following characteristics: When the cylinder air-fuel ratio corresponding value $\alpha An$ is positive, it is judged that the cylinder air-fuel ratio comes to the rich side relative to the stoichiometric value. Accordingly, the ignition timing correction amount $\Delta ACV_n$ is set at a negative value whose magnitude is in accordance with the absolute value of $\alpha A_n$ thereby correcting the ignition timing to a retarded side. When the cylinder air-fuel ratio corresponding value $\alpha An$ is negative, it is judged that the cylinder air-fuel ratio comes to the lean side relative to the stoichiometric value. Accordingly, the ignition timing correction amount $\Delta ACV_n$ is set at a positive value whose magnitude is in accordance with the absolute value of $\alpha A_n$ thereby correcting the ignition timing to an advanced side.

When the ignition timing correction amount $\Delta ADV_n$ is thus calculated for each cylinder la, the value of this amount $\Delta ADV_n$ is used in the above-mentioned $ADV_n$ calculation routine of FIG. 5 so that the correction of the ignition timing is accomplished for the ignition cylinder. Accordingly, in case that the air-fuel ratio feedback correction coefficient $\alpha$ changes as shown in FIG. 8A, the actual cylinder air-fuel ratio (cylinder A/F) in each cylinder C changes as shown in FIG. 8B. At this time, the ignition timing is corrected by virtue of the ignition timing correction amount $\Delta ADV_n$ thereby to take an ignition characteristics shown in FIG. 8C in which the ignition timing changes to the advanced side and to the retarded side relative to a predetermined basic ignition timing. As a result, engine revolution of the engine E can be effectively prevented from its fluctuation without occurrence of engine hunting.

In case that the current condition is not in the air-fuel ratio feedback control region (F/B region) nor in the ignition timing correction region, the flow goes to a step 48 upon judgment at the step 41 or the step S42. At the step S48, "0" is reset at the ignition timing correction flag F, and thereafter the flow of this routine is terminated.

As appreciated from the above, according to the embodiment, the air-fuel ratio in each engine cylinder is precisely detected, upon which the correction of ignition timing is carried out in accordance with the air-fuel ratio in the engine cylinder. Accordingly, this effectively prevents engine hunting and particularly engine revolution fluctuation at engine idling.

It will be understood that the ignition timing correction of this embodiment is effective in engine operating regions other that engine idling. For example, at a low engine speed and high engine load operating condition, engine running stability is unavoidably degraded because correction of the ignition timing in an advanced side is limited owing to occurrence of engine knocking. Accordingly, in a conventional control manner, an air-fuel ratio feedback control is prohibited at such a low engine speed and high engine road operating condition, thereby unavoidably fixing the air-fuel ratio at a rich side so as to maintain engine running stability. However, according to the ignition timing correction of the embodiment of the present invention, it is unnecessary to prohibit the air-fuel ratio feedback control and therefore, the engine running stability can be effectively obtained even during the air-fuel ratio feedback control, thus extending engine operating regions in which the air-fuel ratio feedback control can be carried out, while improving exhaust gas purifying performance and fuel economy.

Additionally, the air-fuel ratio in the engine cylinder is effectively calculated from an air-fuel ratio feedback control parameter taking account of a predetermined time lag characteristic as shown in FIG. 10B. Consequently, the actual air-fuel ratio prevailing in the cylinder can be precisely detected without adding a special sensor, thereby contributing to simplification of the control system while avoiding difficulties encountered in directly detecting an actual air-fuel ratio in the cylinder.

What is claimed is:

1. An ignition timing control system for an internal combustion engine, in combination with an air-fuel ratio feedback control system including an air-fuel ratio sensor disposed in an exhaust gas passageway to generate a signal representative of an air-fuel ratio of exhaust gas, means for setting an air-fuel ratio feedback correction coefficient in accordance with said signal to correct a fuel injection amount so as to feedback-control the air-fuel ratio to a stoichiometric air-fuel ratio;

said ignition timing control system comprising means for detecting an air-fuel ratio within a combustion chamber of an engine cylinder of the engine;

means for calculating an ignition timing correction amount in accordance with said air-fuel ratio within the combustion chamber; and means for correcting an ignition timing set in accordance with an engine operating condition, in accordance with said ignition timing correction amount.

2. An ignition timing control system as claimed in claim 1, wherein said ignition timing correction amount calculating means includes means for calculating said ignition timing correction amount in accordance with a difference between said air-fuel ratio within the combustion chamber and the stoichiometric air-fuel ratio.

3. An ignition timing control system as claimed in claim 1, wherein said air-fuel ratio detecting means includes means for calculating said air-fuel ratio within the combustion chamber, in accordance with said air-fuel ratio feedback correction coefficient and a predetermined time lag between a first change in said air-fuel ratio feedback correction coefficient and a second change in said air-fuel ratio within the combustion chamber, said first and second changes corresponding to each other in air-fuel ratio.

4. An ignition timing control system as claimed in claim 3, further comprising means for determining said predetermined time lag upon taking account of a fuel flow on a wall surface of an air intake passageway between a first location at which a fuel injector valve is disposed and a second location adjacent the combustion chamber.

5. An ignition timing control system as claimed in claim 3, wherein said ignition timing correcting amount calculating means includes means for obtaining said ignition timing from a map in which said ignition timing correction is set in accordance with said air-fuel ratio within the combustion chamber.

6. An air-fuel ratio control system as claimed in claim 1, wherein said ignition timing correcting means includes means for obtaining a basic ignition timing in accordance with an engine speed and a basic fuel injection amount, and means for correcting said basic ignition timing in accordance with said ignition timing correction amount.

7. An air-fuel ratio control system as claimed in claim 1, wherein at least a part of said air-fuel ratio detecting means, said ignition timing correction amount calculating means and said ignition timing correcting means constitutes a microcomputer.

* * * * *